US008056609B2

(12) United States Patent
Wong et al.

(10) Patent No.: US 8,056,609 B2
(45) Date of Patent: Nov. 15, 2011

(54) CORE FOR CASTING

(75) Inventors: Natalie Wong, Bristol (GB); Richard Green, Bristol (GB)

(73) Assignee: Rolls-Royce PLC, London (GB)

( * ) Notice: Subject to any disclaimer, the term of this patent is extended or adjusted under 35 U.S.C. 154(b) by 356 days.

(21) Appl. No.: 12/289,839

(22) Filed: Nov. 5, 2008

(65) Prior Publication Data

US 2009/0151888 A1 Jun. 18, 2009

(30) Foreign Application Priority Data

Dec. 14, 2007 (GB) ..... 0724387.6

(51) Int. Cl.
*B22C 9/10* (2006.01)
*B22D 23/00* (2006.01)
*B28B 7/30* (2006.01)

(52) U.S. Cl. ..... 164/137; 164/368; 164/369; 249/176

(58) Field of Classification Search ..... 164/137, 164/368, 369, 132, 345, 346; 249/176
See application file for complete search history.

(56) References Cited

U.S. PATENT DOCUMENTS

| | | | | |
|---|---|---|---|---|
| 1,586,321 A | | 5/1926 | Newport | |
| 2,405,254 A | | 8/1946 | Hopkins | |
| 2,814,084 A | * | 11/1957 | Covitt et al. | 249/63 |
| 3,506,235 A | * | 4/1970 | Katz et al. | 249/82 |
| 4,362,686 A | * | 12/1982 | Clishem et al. | 264/317 |
| RE31,488 E | | 1/1984 | Trumbauer | |
| 4,462,453 A | | 7/1984 | Trumbauer | |

FOREIGN PATENT DOCUMENTS

| | | | |
|---|---|---|---|
| DE | 1 173 618 | | 7/1964 |
| DE | 25 05 094 | | 8/1976 |
| DE | 25 05 094 A | * | 8/1976 |
| EP | 1 721 688 A1 | | 11/2006 |
| GB | 917491 | | 2/1963 |

OTHER PUBLICATIONS

Jun. 30, 2009 Extended Search Report issued in European Patent Application No. 08019232.1.

* cited by examiner

*Primary Examiner* — Kevin P Kerns

(74) *Attorney, Agent, or Firm* — Oliff & Berridge, PLC

(57) ABSTRACT

A core for casting a container includes a casting surface, where the core is divided into at least two core segments. The casting surface of each core segment adjoins a division surface, and the division surface of each core segment is spaced apart from the division surface of a neighboring core segment by a gap. The gap is spanned by a frangible collapsible member such that substantially all of the casting surface is free of the collapsible member.

17 Claims, 4 Drawing Sheets

CORE FOR CASTING

BACKGROUND

This invention relates to a core for casting a container, apparatus for casting a container and a method for casting a container.

In particular it relates to a core, apparatus and method for casting a container comprising a core divided into least two core segments.

It is well known in the art to cast hollow components using a mould and core, where the core sits inside the mould and defines the shape of the internal features of the casting. The core may be made from a fired ceramic or a sand and resin mix and consequently the casting alloy tends to have a considerably faster thermal contraction rate to that of the material of the core. For hollow components which surround the core, this results in the component shrinking onto the core, with solidified regions of the casting applying tensile hoop stresses to semi-molten areas. This induced stress can cause the casting to tear or crack before cooling and solidification is complete, and thus before all regions of the casting have gained sufficient strength to resist cracking or tearing.

Cores can hollowed out, and optionally filled with a low-density material such as polystyrene, thereby enabling them to fracture or crumble, and therefore contract along with the casting. However, the walls of the cores can only be thinned so much before they lose structural integrity and are unable to maintain the required shape during the pouring of the molten metal. Hence a balance is required between weakening the core to allow it to collapse during the cooling process and leaving sufficient core material to retain the required shape during the pouring of the molten metal.

Alternatively the wall thickness of the casting can be increased such that cracking/tearing does not occur. Clearly this is undesirable as this either increases overall component weight, or increases the cost of manufacture as additional machining operations are required to remove the excess material to reduce wall thickness to a desired size.

U.S. Pat. No. 3,506,235 (Katz et al.) describes a heat sink core comprising a plurality of segments which are spaced apart and surrounded by a sleeve which fractures when the casting cools. Resilient spacers are provided between the segments. The sleeve blocks the gap between segments but gives way when enough pressure is applied during cooling/contraction of the casting. However, the invention of Katz et al can only be used for the manufacture of annular, cylindrical, smooth sided and open ended components, since the sheath has to fit neatly and evenly around the segmented core.

SUMMARY

An object of the present invention is to provide a casting core and method for the manufacture of a container (ie an enclosed vessel) of regular or irregular shape, which reduces the likelihood of tearing or cracking of the casting material during solidification.

According to a first aspect of the present invention, there is provided a core for casting a container comprising a casting surface, wherein the core is divided into at least two core segments, the casting surface of each core segment adjoins a division surface, and the division surface of each core segment is spaced apart from the division surface of a neighbouring core segment by a gap, the gap is spanned by a collapsible member such that substantially all of the casting surface is free of the collapsible member, characterised in that the collapsible member is frangible.

According to a second aspect of the present invention, there is provided apparatus for casting a container comprising a core according to the first embodiment of the present invention.

According to a third aspect of the present invention, there is provided a method for casting a container using apparatus comprising a core according to the first aspect of the present invention, comprising the steps of: aligning the core segments along their division surfaces, and providing a collapsible member along an edge of the division surfaces such that substantially all of the casting surface of the segment is free of the collapsible member.

In relation to the present invention, the term "segment" is taken to me a portion which can be formed either separately from, or formed integrally with, an adjacent portion.

Thus the collapsible member is provided only in the region of the gap between the core segments, and the casting surface is left uncovered except in areas where the casting surface is optionally utilised to provide support for the collapsible member, thereby preventing it from falling into the gap until it collapses. This enables segmented cores with a wide range of shapes and casting surface features to be assembled to form a single core which can contract as the casting contracts, but which leaves the casting surface substantially intact and in contact with casting material throughout solidification. In particular this is of benefit with thin walled casings, where the walls of the component being cast do not have sufficient strength as the casting cools to resist tearing and cracking. The invention is also of benefit where the core has re-entrant features which must remain in contact with the casting surface and intact throughout the casting process so that the final product has the desired profile. For example, a container or tank with side walls, a base and a flange which extends around the walls for a lid can be conveniently cast using the apparatus of the present invention.

Use of apparatus or method of the present invention will reduce the incidence of cracks or tears during casting, and hence reduces the amount of scrapped or reworked parts. It also enables a casting to be produced which has a wall thickness close or the same as that of the finished product. That is to say, there is no longer any requirement to cast over thick walls to avoid cracks and tears, and then machine down to size.

BRIEF DESCRIPTION OF THE DRAWINGS

The invention will now be described, by way of example only, with reference to the accompanying drawings, in which.

DETAILED DESCRIPTION OF EMBODIMENTS

Figure 1:
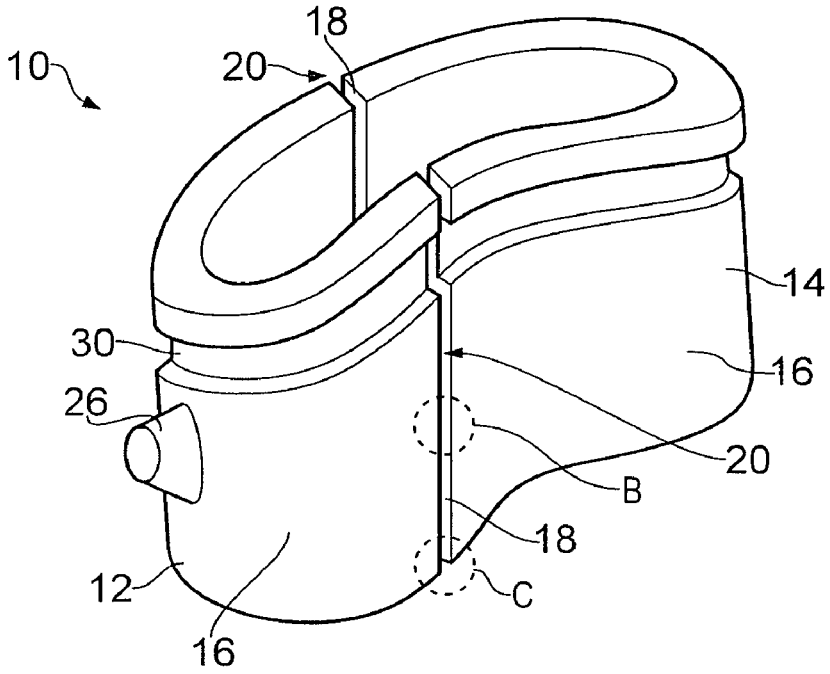
FIG. 1 shows a perspective view of aligned core segments of the container casting apparatus according to the present invention.
Figure 2:
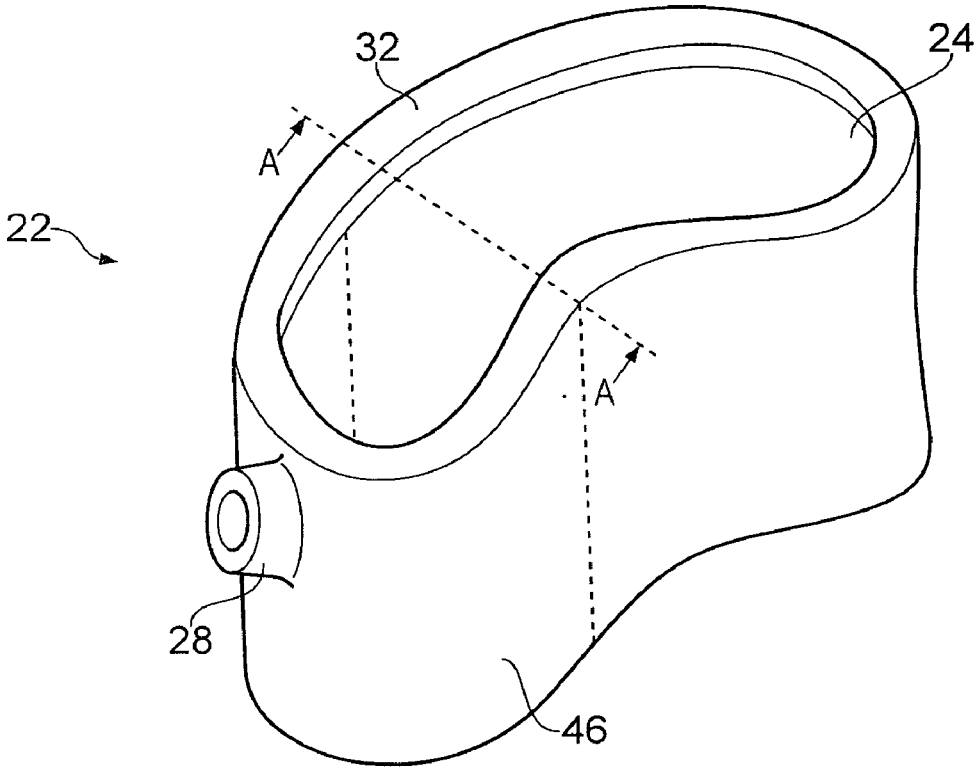
FIG. 2 shows a perspective view of a container/tank made by using the core shown in FIG. 1.
Figure 3:
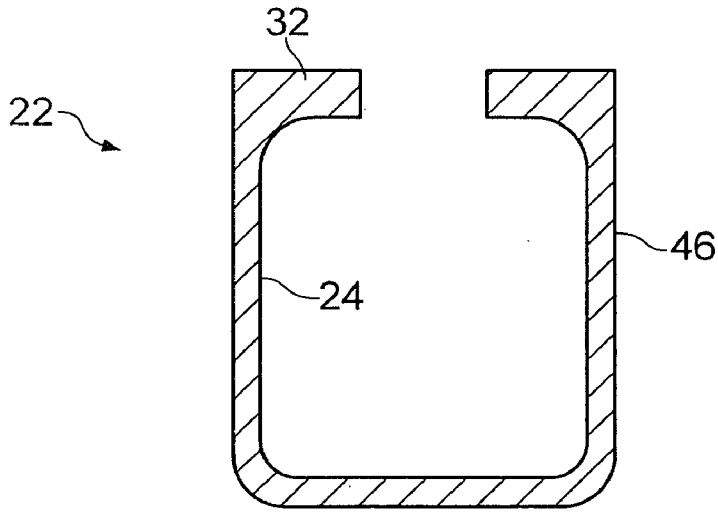
FIG. 3 is a cross-sectional view of the container/tank at a position indicated at line A-A in FIG. 2.

FIG. 1 shows a segmented central casting core 10 according to the present invention, for casting a container component 22, shown in FIG. 2. A cross section of the finished container component 22, indicated at A-A in FIG. 2, is presented in FIG. 3. The segmented core 10 is divided into first and second segments 12,14. The core segments 12,14 each have a casting surface 16 which adjoins a division surface 18. The casting surface 16 is the surface which, in use, defines the shape of inside 24 of the component 22, and which in use is surrounded by the casting component 22. The division surface 18 of segments 12,14 are complementary in shape and are spaced apart to define a gap 20 between the segments 12,14.

When the core segments 12,14 are aligned, their casting surfaces 16 define a crescent, lozenge or "kidney" shape with a taper ratio of less than 3.5. The taper ratio is the ratio of the widest to the narrowest part of the crescent shape in section, measured from the apex at the extreme of each segment 12,14. A raised feature 26 on the casting surface defines the inside of a boss 28 on the component 22. A channel 30 formed around the entire perimeter of the casting surface defines the shape of a flange 32 at an opening in the component 22, thereby defining an open ended vessel.

Figure 4:
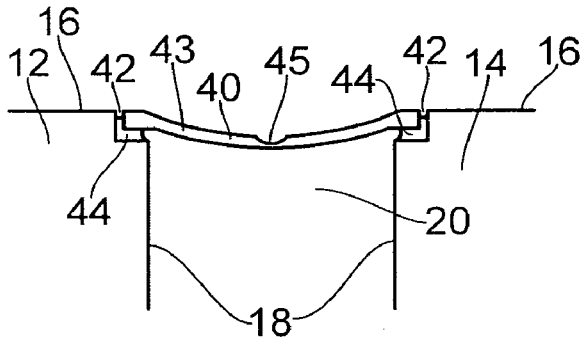
FIG. 4 is an enlarged view of the assembled core of FIG. 1 in a region "B" where a concave plate-like collapsible member is positioned over the gap between segments.

Turning to FIG. 4, after the segments 12,14 have been assembled, a collapsible member 40 is positioned such that it covers the gap 20. That is to say, the collapsible member 40 spans the gap 20 such that, in use, the member 40 prevents casting material from entering the gap 20. The collapsible member 40 sits on the edge of the casting surface 16 of each segment 12,14, in a recess (or rebate) 42. That is to say, a recess 42 is provided at the transition between the casting surface 16 and the division surface 18 for receiving the collapsible member 40. In this embodiment, the collapsible member 40 is a concave plate 43, with the apex of the plate 43 directed into the gap 20. A bonding agent 44 adheres the concave plate 43 to the core segments 12,14. Predominantly all of the casting surface 16 is left free of the collapsible member 40. The collapsible member 40 extends only a short distance onto the casting surface 16 such that the internal shape of the casting component 22 is defined in the main by the casting surface 16. The concave plate 43 has a waisted section 45 part way along its width. When the apparatus is assembled, the waisted section is substantially parallel to the edges of the core segments 12,14.

Figure 6:
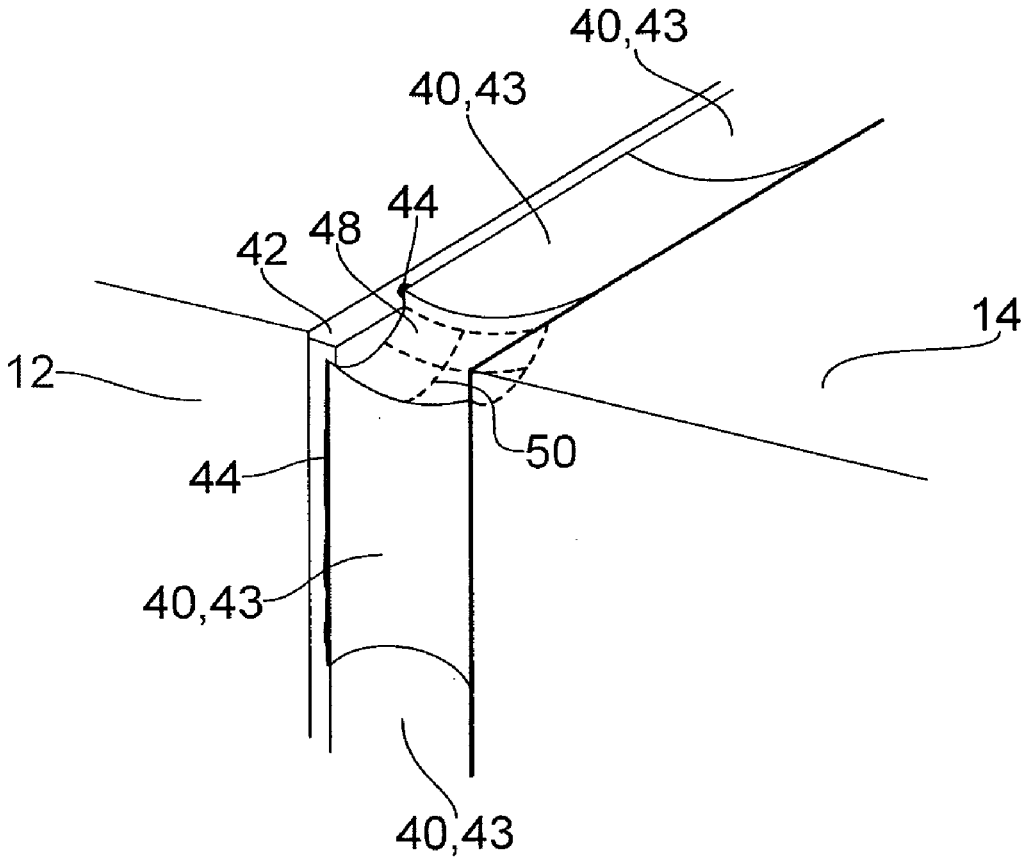
FIG. 6 is an enlarged view of the assembled core of FIG. 1 in region "C" where collapsible members comprising a collection of concave plates are positioned to span gaps between segments.

FIG. 6 shows an enlarged view of corner region "C" indicated in FIG. 1. A plurality of collapsible members 40 are fixed in place with a bonding agent 44 (for example, fire clay) into place such that they follow the entire perimeter of the core 10. At corners, a corner collapsible member 48 is fitted which has square edges and a concave profile, with the apex of the profile being directed towards the gap 20. The corner collapsible member 48 has weakened features 50, for example small grooves etched into the face of the member 48, such that it will fracture when the required force is applied.

Figure 5:
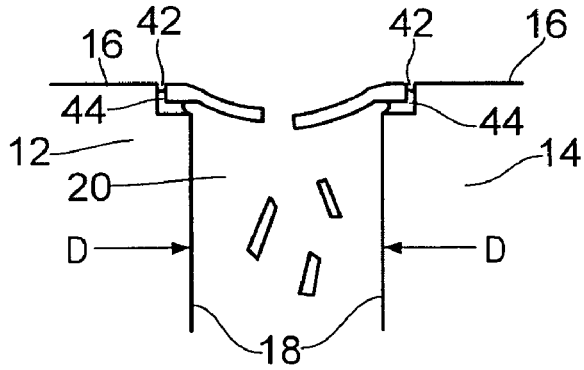
FIG. 5 is the same view as FIG. 4, but shows the fracture of the collapsible member as the core segments are drawn together by the contraction of the core segments.

During the casting process, the core 10 is placed inside, and spaced apart from a mould (not shown) which defines the external surface 46 of the component 22. Molten casting material is introduced into the space between the mould and the core 10. The curved surface of the collapsible members 40,43,48 is able to withstand pressure loads from the casting material. As the molten material solidifies, it will contract. Since the material of the core 10 has a significantly lower co-efficient of thermal expansion than the casting material, the solidifying casting will shrink around the core 10 and exert a force upon the casting surfaces 16 in a direction as indicated by the arrows "D" in FIG. 5. Since the collapsible members 40,43,48 are trapped in the recess 42, the compression force is transmitted along the members 40,43,48 until they fracture, and fall in the gap 20. The remains of the members 40,43,48 will fall into the gap 20 rather than into the casting material because the apex of their concave surface is directed towards the core. The segments 12,14 continue to move toward one another, relieving hoop stress on the casting material, and reduce the likelihood of the casting tearing. The position of the division/gap 20 between the segments 12,14 is located in a region which is predetermined to be where the molten casting material will solidify in an early part of the casting cooling process. Thus the casting material is partly solidified at this point, so no casting material will flow into the gap 20. Undesirable features made on the internal surface 24 of the casting can be removed in a simple machining operation.

Figure 7:
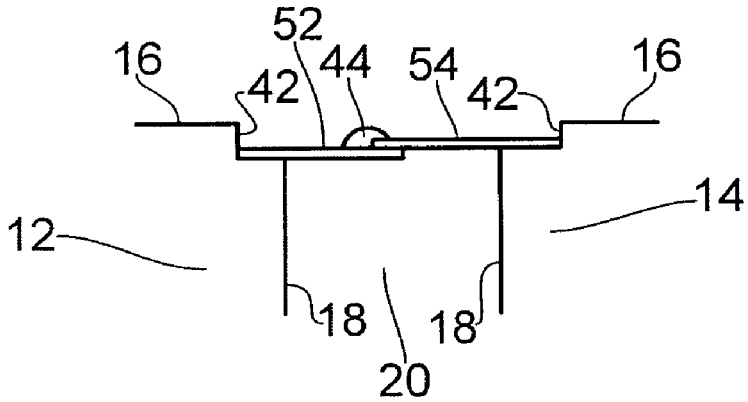
FIG. 7 presents the same view as presented in FIG. 4, but shows a different embodiment where the collapsible member is provided as overlapping plates.

An alternative embodiment of the present invention is shown in FIG. 7, in which the collapsible members 40 are provide as flat plate/strip parts 52,54. These flat parts 52,54 extend from the edge of each core segment 12,14, located in a rebate 42, such that when the segments 12,14 are in alignment, the flat part 52 which extends from one segment 12 overlaps the flat part 54 which extends from a cooperating segment 14. A bonding agent 44 is applied where the plates 52,54 overlap to hold them together. In use, as a casting contracts around the core 10, the plates 52,54 and/or bonding agent 44 are compressed until they fail, break into pieces and fall into the gap 20. In all other respects, this embodiment performs in the same way as the embodiment shown in FIGS. 4, 5 and 6.

Figure 8:
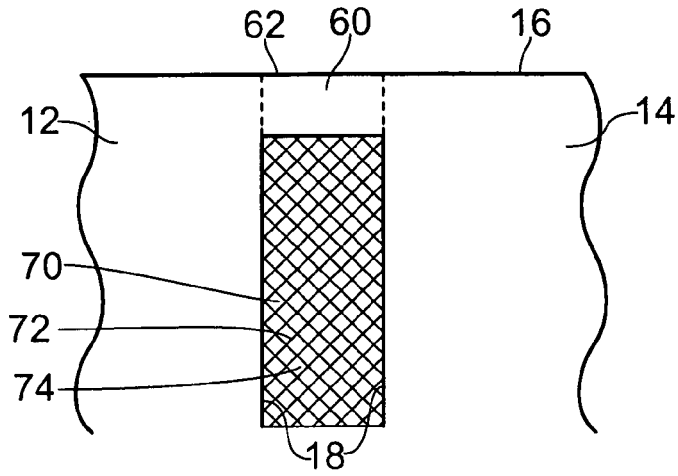
FIG. 8 presents the same view as FIG. 4, but shows a further embodiment in which two compressible members are provided, the first being a honeycomb structure, the second being a frangible fill material.
Figure 9:
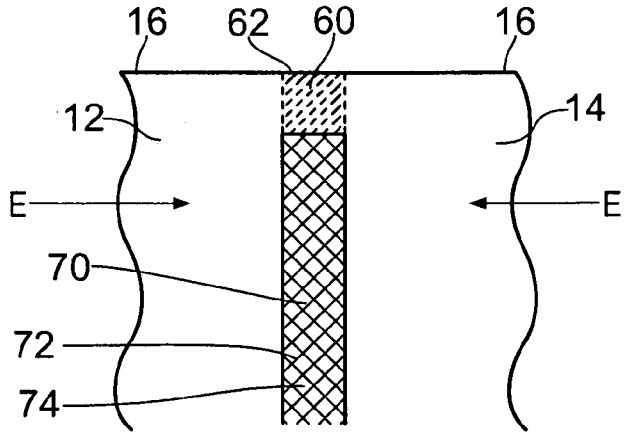
FIG. 9 presents the same view as FIG. 8, but shows the compression of the collapsible members as the core segments are drawn together by the contraction of the core segments.

An further alternative embodiment of the present invention is shown in FIGS. 8 and 9, in which, instead of curved or flat plates, the collapsible member is provided as a frangible fill material 60 which spans the gap 20. The outer surface 62 of the frangible fill material 60 may be given a flat profile, or a concave profile with the apex of the curve being directed towards the gap 20 between the division surfaces 22. As the casting shrinks around the core 10, the core segments 12,14 compress the frangible fill material 60, and it crumbles, allowing the core segments 12,14 to move towards one another. The frangible fill material 60 may be the same material, and have the same consistency, as the material of the core segments 12,14. Alternatively the collapsible member of frangible fill material 60 may be made of substantially the same material as the core segments 12,14, but be configured such that it is more brittle. The frangible fill material 60 may be formed integrally with one or both of the core segments 12,14, or may be inserted in the gap 20 after the segments 12,14 have been aligned.

Additionally or alternatively, a further collapsible member provided as a gasket 70 is disposed between the division surfaces 18 of the segments 12,14. The gasket 70 may be corrugated or have a honeycomb structure 72 with closed or open cells 74. Alternatively it may be substantially solid. The gasket is configured to compress as the core segments 12,14 are forced together under the pressure of a contracting casting 22, as indicated by arrows "E" in FIG. 9. Optionally the gasket 70 is resilient, that is to say, it can spring back to its former shape when the core segments are separated. In an alternative embodiment, the gasket 70 is frangible, and fractures as the core segments 12,14 are brought together under the pressure of a contracting casting 22. If used in combination with a collapsible member made of frangible fill material 60, as shown in FIGS. 8 and 9, the frangible fill material 60 is crushed as the core segments 12,14 are forced together, and fragments of the collapsible member made of frangible fill material 60 are retained by the gasket 70, and the outer surface 62 of the frangible fill material 60 provides a link between the casting surfaces 16 of the core segments 12,14.

In a further alternative embodiment, the gasket material 70 is incorporated into the core 10 when the core 10 is manufactured. The gasket material 70 may be cardboard or expanded polystyrene.

In a further alternative embodiment, the gasket 70 has an ignition temperature below the melting point of the material of the core segments 12,14. When molten metal is poured into the mould with the core 10, the gasket 70 burns away, leaving a space so that the core segments 12,14 can move towards one another. Preferably in this embodiment a collapsible member of frangible fill material 60 is provided at the surface of the core segments 12,14, as shown in FIGS. 8 and 9, in order to prevent burnt debris interfering with the cast surface around this area.

The core 10 may be disposable, that is to say, used only once. Once the casting 22 has cooled, the core 10 is 'knocked out' by placing the component 22 a vibrating base which shakes the core and mould into pieces. Alternatively the core 10 is removed with a hammer, shot or similar impact device. A further alternative method of removal may be employed where one or more constituent of the core material is dissolved such that the core 10 loses integrity and becomes a solution or suspension which can be bled out of the casting.

In one embodiment the casting material is an aluminium alloy, in particular an alloy having the composition Al-5Cu-1.5Ni-0.25Co-0.25Sb-0.25Mn-0.2Zr-0.2Ti. When this alloy is molten it is "treacle-like", that is to say is relatively viscous compared to many molten metals, and is difficult to pour. This high viscosity prevents flow of material from thick to thin regions during cooling of the casting, thereby increasing the chance of thin walled regions cracking or tearing.

In one embodiment the casting component 22 is a thin walled oil tank for a gas turbine engine. The oil tank is crescent shaped, with its longest dimension from apex to apex being approximately 500 mm, and being approximately 150 mm wide at its widest point, and approximately 250 mm deep. It is believed that during cooling/solidification, up to half a tonne of load is exerted by the cooling component 22 on the core 10, which can be successfully relieved by the provision of the gap 20 and collapsible member, where the gap 20 is approximately a 1 mm space provided between the division surfaces 18.

The invention claimed is:

1. A core for casting a container comprising:

at least two core segments each having a casting surface and a division surface, the casting surface of each of the at least two core segments being adjoined to the division surface of each of the at least two core segments, and the division surface of each of the at least two core segments being spaced apart to define a gap; and a collapsible member disposed to cover the gap, wherein the collapsible member does not remain intact while remaining in the solid state during the casting process.

2. The core for casting as claimed in claim 1, wherein the collapsible member has a waisted section part way along its width, which, when the core is assembled, is substantially parallel to the division surfaces.

3. The core for casting as claimed in claim 1, wherein the collapsible member is concave, with the apex of the collapsible member directed into the gap.

4. The core for casting as claimed in claim 1, wherein the collapsible member comprises a part which extends from each of the at least two core segments, such that when the at least two core segments are in alignment, the part which extends from one of the at least two core segments overlaps a part which extends from an other of the at least two core segments.

5. The core for casting as claimed in claim 1, wherein the collapsible member is disposed between the division surfaces of the at least two core segments.

6. The core for casting as claimed in claim 1, wherein the collapsible member is carried on the casting surface.

7. The core for casting as claimed in claim 6, wherein the casting surface and the division surface for one of the at least two core segments define a recess for receiving the collapsible member.

8. The core for casting as claimed in claim 1, wherein the collapsible member is made of substantially the same material as the at least two core segments.

9. The core for casting as claimed in claim 8, wherein the collapsible member is formed integrally with the at least two core segments.

10. The core for casting as claimed in claim 1, wherein the collapsible member is bonded to the at least two core segments.

11. The core for casting as claimed in claim 1, wherein the collapsible member comprises a honeycomb structure.

12. The core for casting as claimed in claim 1, wherein the material of the collapsible member ignites at a temperature below the melting point of the core material.

13. The core for casting as claimed in claim 1, wherein the collapsible member is compressible.

14. An apparatus for casting a container comprising the core as claimed in claim 1.

15. A method for casting a container using an apparatus comprising a core as claimed in claim 1 comprises:

aligning each of the at least two core segments along their division surfaces, wherein a position of the division surface of each of the at least two core segments is located in a region on the at least two core segments predetermined by where a molten material will solidify in an early part of a casting cooling process;

disposing the collapsible member along an edge of the division surface of each of the at least two core segments such that substantially all of the casting surface of each of the at least two core segments is free of the collapsible member; and introducing the molten material around the at least two core segments to form a casting, wherein the collapsible member collapses around the at least two core segments during solidification of the casting.

16. The core for casting as claimed in claim 1, wherein substantially all of the casting surface of each of the at least two core segments is free of the collapsible member.

17. The core for casting as claimed in claim 1, wherein the core segments have an irregular shape.

* * * * *